United States Patent [19]

Van Bakel et al.

[11] 3,973,816

[45] Aug. 10, 1976

[54] METHOD OF GETTERING A TELEVISION DISPLAY TUBE

[75] Inventors: Adrianus Maria Van Bakel; Jan Josephus Bernardus Fransen; Adrianus Kuiper, all of Eindhoven, Netherlands

[73] Assignee: U.S. Philips Corporation, New York, N.Y.

[22] Filed: Apr. 14, 1975

[21] Appl. No.: 567,642

Related U.S. Application Data

[62] Division of Ser. No. 388,394, Aug. 15, 1973, abandoned.

[30] Foreign Application Priority Data

Sept. 30, 1972 Netherlands ..... 7213275

[52] U.S. Cl. ..... 316/25; 252/181.4; 252/181.6

[51] Int. Cl.[2] ..... H01J 7/18

[58] Field of Search ..... 316/25, 24, 3; 252/181.1, 181.2, 181.3, 181.4, 181.6

[56] References Cited

UNITED STATES PATENTS

| | | | |
|---|---|---|---|
| 1,894,948 | 1/1933 | Espe et al. | 316/25 |

FOREIGN PATENTS OR APPLICATIONS

| | | | |
|---|---|---|---|
| 2,145,159 | 3/1972 | Germany | 252/181.4 |
| 939,042 | 2/1956 | Germany | 252/181.4 |
| 898,505 | 6/1962 | United Kingdom | 316/25 |

OTHER PUBLICATIONS

Johnson et al., "J. Am. Chem. Soc.," vol. 56, 1934, pp. 2395–2397.

*Primary Examiner*—Roy Lake
*Assistant Examiner*—James W. Davie
*Attorney, Agent, or Firm*—Frank R. Trifari; Carl P. Steinhauser

[57] ABSTRACT

A method of absorbing residual gases in a television display tube wherein a holder containing a barium-aluminum alloy, germanium nitride ($Ge_3N_4$) and a nickel containing material is placed in the tube and heated to release the nitrogen and barium which is dispersed within the tube in such manner that the amount deposited on the screen is minimized.

6 Claims, 3 Drawing Figures

METHOD OF GETTERING A TELEVISION DISPLAY TUBE

This is a division, of application Ser. No. 388,394, filed Aug. 15, 1973, now abandoned.

The invention relates to a gettering device for a picture display tube, comprising a barium aluminum alloy ($BaAl_4$), means for the rapid release therefrom of the barium and the chemical binding of the aluminum, and a nitrogen source which comprises a nitrogen compound which decomposes during the evaporation of the barium.

Such a getter is known from the British Pat. Specification No. 1,086,489. In this device, barium is evaporated in the presence of nitrogen gas during the manufacture of the picture display tube with the intention of influencing the direction of evaporation of the barium in such manner that the deposition thereof is restricted on the display screen and is stimulated on the conical part of the display tube. An important advantage of this method is that in this manner a porous layer of barium is obtained which is absorbing over a large area. According to the British patent, a given quantity of nitrogen gas is introduced into the tube by decomposition of iron nitride ($Fe_4N$) which has been added to the other constituents of the gettering device. The nitrogen is liberated during the heating of the gettering device before the barium begins to evaporate. Although as a result of this a dispersing influence is directly exerted on the barium evaporated in the first instance, a drawback is that said dispersing influence is considerably smaller in the second phase of the evaporation as a result of the absorption of nitrogen which has meanwhile taken place. A result of this is that the initially porous barium layer in this phase is covered with a layer which has a considerably less porous structure.

Another drawback is that the comparatively low composition temperature of iron nitride may result in an early decomposition of said compound during the degassing process of the tube and the components of the tube.

In order to avoid these drawbacks, it has been proposed to use a nitrogen source which consists of a compound of iron, germanium and nitrogen, specifically $Fe_2Ge$ nitride and $FeGe_2$ nitride which begin to decompose at approximately 600°C. As compared with iron nitride which begins to decompose at 500°C, only a small improvement is obtained in this respect. No improvement at all is obtained from said ternary compounds, if, in order to obtain argon-poor or argon-free gettering devices, the latter have to be pre-degassed at a high temperature. As is known, argon which is released inter alia during the heating of the gettering device in the tube, is not absorbed by the barium. Particularly in display tubes having a great current density, the argon present in the tube is easily ionised and the cathodes may be inadmissibly damaged by ion bombardment.

Such a damage may also occur when methane ($CH_4$) is present in the tube. Like argon, methane is not or hardly absorbed by barium. In order to restrict the quantity of argon and methane in the display tube it is necessary to thoroughly degas the gettering device. However, this is possible only if the gettering device can be maintained in a vacuum at a high temperature for some time without an early decomposition of the nitrogen source taking place. The known nitrogen compounds, such as iron nitride and the said ternary compounds, have too low a decomposition temperature to enable such a pre-degassing of the gettering device.

It is an object of the invention to provide a gettering device of the type described in the first paragraph which does not exhibit said drawbacks. For that purpose a gettering device according to the invention comprises a nitrogen source which contains germanium nitride ($Ge_3N_4$) in the free state.

Germanium nitride is a chemically particularly resistant compound which begins to decompose slowly in a vacuum at approximately 825°C, while the decomposition sets in readily only at approximately 900°C. This property enables a gettering device according to the invention to be predegassed at temperatures up to 800°C without an early decomposition of the nitrogen compound taking place. In order to realize an effective pre-degassing of the gettering device within a reasonable period of time, according to the invention a degassing temperature exceeding 600°C is used. A getting device according to the invention is preferably predegassed for one hour at a temperature of approximately 700°C. In this manner, a safe temperature margin to the upper limit is observed, while nevetheless a thorough degassing is achieved in a reasonable period of time.

The pre-degassing of the gettering device at such a high temperature has important advantages. Starting from a gettering device which has been pre-degassed at 300°C for 16 hours, it is found that when using a gettering device which corresponds as regards dimensions and composition and which has been subjected to an extra degassing at 700°C for one hour, the quantity of argon in the tube after evaporation of barium has descreased by a factor of at least ten and the quantity of methane has descreased by a factor of at least fifteen.

It is to be noted that according to an X-ray diffraction analysis, the ternary compound $FeGe_2$-nitride mainly consists of $\beta$—$Ge_3N_4$ with a small share of $Fe_4GeN$. However, the $Ge_3N_4$ does not occur therein in the free state. Moreover, said ternary compound begins to decompose at 600°C so that an effective pre-degassing of a gettering device equipped therewith would not be possible within a resonable period of time.

Furthermore, $FeGe_2$-nitride, like iron nitride, can be connected in a holder or to a fixed substrate by a compression operation only with difficulty, which, when using said nitrogen compounds, does not favour the compression properties of the filling of the gettering device as such.

In order to enable a rapid decomposition of the said barium aluminum alloy succeeded by a rapid evaporation of the barium, the gettering device according to the invention preferably comprises a mixture of barium-aluminum and nickel. These two materials set in an exothermal reaction at approximately 825°C, at which the nickel binds the aluminum and the releasing barium begins to evaporate. This means that the barium begins to evaporate an ample period of time before the germanium nitride has reached its full decomposition speed. The result of this is that in the first phase of the evaporation a disturbing influence is hardly exerted on the barium. The advantage is, however, that in the second phase of the evaporation said disturbing influence will be present indeed, which results in a barium layer having a porous surface.

As already stated, germanium nitride ($Ge_3N_4$) is a chemically particularly resistant compound. This property may advantageously be used if the gettering device during the manufacture of a picture display tube is exposed to moist air of comparatively high temperature. Such conditions occur, for example, in manufacturing a color television display tube. In this application, the gettering device is already mounted in a place inside the tube before the window is secured to the cone of the tube. This connection is carried out in a furnace in which a temperature of approximately 450°C is maintained for 1 hour. The nickel present in the gettering device for rapidly releasing barium is found to be not resistant to such conditions. It has been proposed, there-fore to replace the nickel by a titanium-containing material which is resistant to said circumstances, which consists of FeTi or $NiTi_2$ or a mixture thereof for at least 50% by weight, and for the possibly remaining percentage consists of $Ni_3Ti$. When according to the invention such a gettering device comprises germanium nitride ($Ge_3N_4$) as a nitrogen source, a gettering device is obtained of which all the constituents in themselves are resistant to moist air of a high temperature while maintaining the advantages already mentioned above.

The invention will be explained with reference to a drawing in which

Figure 1:
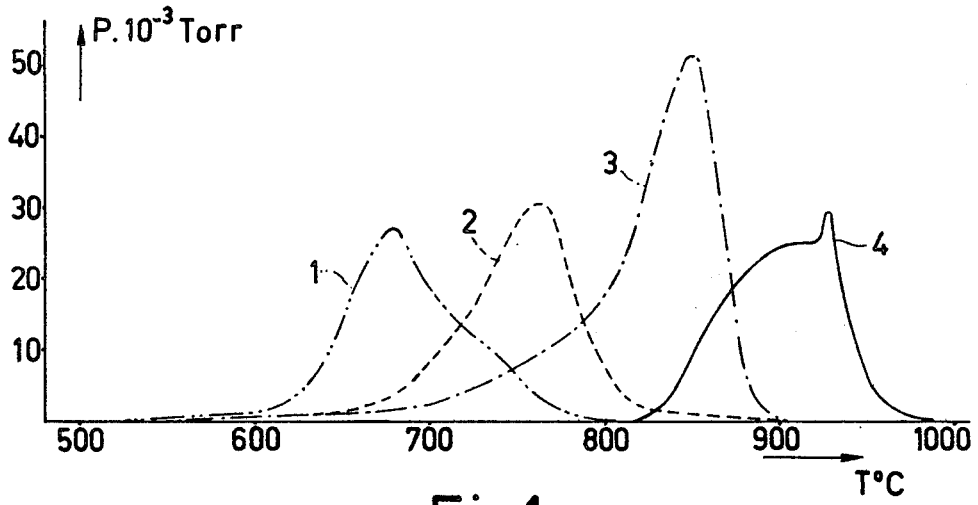
FIG. 1 shows a decomposition curve of germanium nitride ($Ge_3N_4$) as compared with those of iron nitride, $Fe_2Ge$ nitride and $Ge_2Fe$ nitride.

The decomposition curves in FIG. 1 give the nitrogen pressure measured in a thermo balance during the decomposition of a nitrogen compound as a function of the temperature. The thermobalance consisted of an evacuated chamber of a capacity of approximately 5 liters in which a nitrogen compound was caused to decompose by heating at a rate of 24°C per minute. During the experiment the said chamber was connected to a vacuum pump operating at a pumping speed of 0.4 liter per second. Curve 1 shows the pressure in the chamber as a function of the temperature during the decomposition of 95.6 mg of iron nitride. Curve 2 that during the decomposition of 95.6 mg of $Fe_2Ge$ nitride, curve 3 that of 95.6 mg of $Ge_2Fe$ nitride and curve 4 that of 28.8 mg of $Ge_3N_4$. The quantity of germanium nitride is chosen to be so that in comparison with iron nitride the same amount of nitrogen is introduced into the chamber.

It is obvious that the known nitrogen compounds for a gettering device begin to decompose below 600°C, whereas germanium nitride begin to decompose at 825°C only. In spite of the fact that $Ge_2Fe$ nitride is asserted to contain mainly $\beta$—$Ge_3N_4$, said compound has given up substantially all its nitrogen at 870°C, whereas pure $Ge_3N_4$ has not yet 20% decomposed at said temperature. This property is advantageously used during the pre-degassing at high temperature of a gettering device according to the invention.

Figure 2:
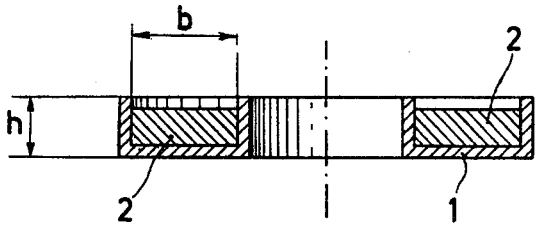
FIG. 2 is an axial cross-sectional view of an embodiment of a gettering device accoding to the invention.

FIG. 2 shows an embodiment of a gettering device according to the invention which consists of an annular chromium-nickel steel channel 1, the width *b* of which is 2 mm, the height *h* 2 mm and the external diameter 18 mm. A mixture of 49 % per weight of barium aluminum ($BaAl_4$), 49 % by weight of nickel and 2 % by weight of germanium nitride ($Ge_3N_4$) has been compressed in the channel 1. The germanium nitride has been manufactured by conducting at 750°C ammonia gas through powdered germanium dioxide. Since $Ge_3N_4$ can easily be ground to any desired grain size, it is not necessary to establish the desired grain size already in the starting material, for example, germanium or germanium dioxide. This in contrast with iron nitride ($Fe_4N$) which cannot be ground to any grain size.

In order to remove argon and other gases as much as possible from the gettering device, same has already been pre-degassed at 700°C for 1 hour, as a result of which the advantages already mentioned above are obtained.

Figure 3:
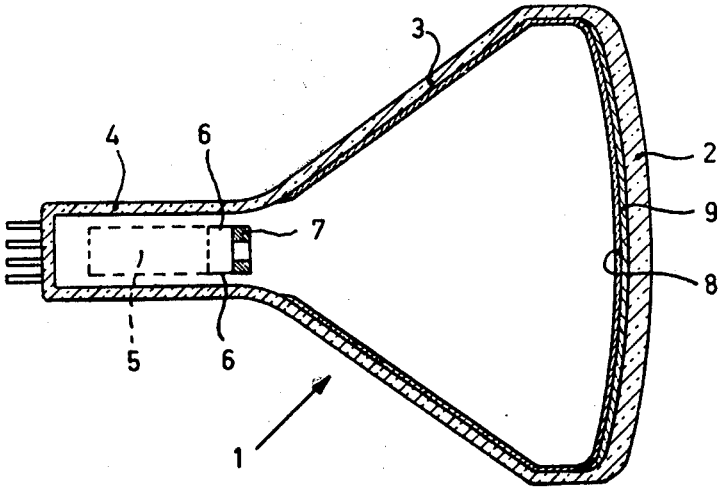
FIG. 3 is a cross-sectional view through a television picture tube manufactured by means of such a gettering device.

The television picture tube shown in FIG. 3, comprises a glass envelope 1 consisting of a window portion 2, a conical portion 3 and a neck 4. Present in the said neck is an electron gun 5 to which a channel-like getter holder 7 is secured by means of metal supporting strips 6. Said getter holder which initially contains a mixture of 49 % by weight of $BaAl_4$, 49 % by weight of Ni and 2 % by weight of $Ge_3N_4$, has been pre-degassed at a temperature of 700°C for 1 hour prior to its connection to the gun so as to obtain a particularly argon-poor getter.

The tube furthermore comprises a phosphor layer 9 which is provided on the inside of the window and which generates the desired light picture upon being scanned by the electron beam originating from the gun. In order to obtain and maintain the vacuum required therein for a good operation, it contains an absorbing layer 8 consisting of barium. Said layer is provided by high frequency heating of the getter holder in which the barium evaporates from the barium aluminum. The exothermally occurring reaction between the aluminum and the nickel present in powder form ensures an extra temperature increase so that a rapid evaporation of the barium is realised. The nitrogen released from the germanium nitride during heating exerts a dispersing effect on the evaporating barium, as a result of which the formation of barium deposits mainly on the central portion of the is prevented. Actually, should this be the case a dark spot will be formed in the central part of the tube during operation of the tube. In order to obtain, however, a uniform distribution of the barium over the window surface, a sufficient quantity of nitrogen should also be present in the tube during the last phase of the evaporation thereof. In this case the higher decomposition temperature of $Ge_3N_4$ relative to the nitrogen parts known for said purpose is advantageously made use of. The nitrogen released in a later stage of the heating therefore also ensures the dispersing effect necessary also in the last phase of the evaporation of the barium.

We claim:

1. A method of absorbing residual gases in a television display tube comprising the steps of heating a holder containing a quantity of $BaAl_4$, a nickel-containing material, and germanium nitride ($Ge_3N_4$), to a temperature of 600° to 800°C to pre-degas the contents of said holder, placing the holder with the predegassed contents in the tube, and thereafter heating the holder contents to a temperature of about 900°C to react the constituents in the holder releasing barium and nitrogen, the barium being deposited as a porous layer of uniform thickness on the wall of the tube.

2. A method as claimed in claim 1 wherein the nickel-containing material is nickel powder.

3. A method as claimed in claim 1 wherein the nickel containing material is a mixture of FeTi and $Ni_3Ti$, the FeTi comprising at least 50% by weight of said mixture.

4. A method as claimed in claim 1 wherein the nickel containing material is a mixture of $NiTi_2$ and $Ni_3Ti$, the $NiTi_2$ comprising at least 50% by weight of said mixture.

5. A method as claimed in claim 1 wherein the nickel containing material is a mixture of FeTi, $NiTi_2$ and $Ni_3Ti$, the FeTi and $NiTi_2$ comprising at least 50% by weight of said mixture.

6. A method as claimed in claim 1 wherein the holder contents are pre-degassed at a temperature of 700°C for one hour.

* * * * *